United States Patent [19]

Taccani

[11] 4,074,413

[45] Feb. 21, 1978

[54] METHOD AND APPARATUS FOR MANUFACTURING SEPARABLE SLIDING CLASP FASTENERS

[76] Inventor: Riccardo Taccani, Via Civitali 50, 20148 Milan, Italy

[21] Appl. No.: 759,572

[22] Filed: Jan. 14, 1977

[30] Foreign Application Priority Data

Jan. 22, 1976 Switzerland ..... 792/76

[51] Int. Cl.[2] ..... B21D 53/50; B29D 5/00

[52] U.S. Cl. ..... 29/408; 29/423; 29/767; 264/161; 264/252; 425/814

[58] Field of Search ..... 29/408, 418, 423, 527.1, 29/766, 767, 768; 425/814; 264/252, 161, 163

[56] References Cited

U.S. PATENT DOCUMENTS

| | | | |
|---|---|---|---|
| 2,464,050 | 3/1949 | Morin | 264/252 |
| 2,511,397 | 6/1950 | Day | 264/252 X |
| 2,977,638 | 4/1961 | Morin | 29/408 X |

*Primary Examiner*—Victor A. DiPalma

*Attorney, Agent, or Firm*—Miller & Prestia

[57] ABSTRACT

A method and an apparatus for manufacturing separable sliding clasp fasteners, from a continuous fastener having the interlocking elements made of thermoplastic material. The two male parts of the separating device of one fastener, the two top stops of another fastener, the support-strips reinforcements along these male parts and stops, and a opening for introducing a sliding clasp are simultaneously manufactured by: introducing the two uncoupled and spaced halves of a continuous fastener into a mold, injecting in the latter a melted thermoplastic material solidifying the thermoplastic material and cutting a part of the solidified material to form the said male parts, stops and opening. The apparatus comprises a mold consisting of a lower half-mold and an upper half-mold each comprising an outer fixed part and a central part perpendicularly movable to this fixed part. The line of contact of these two parts presents the form of the contour of the part of the solidified material to be cut by the displacement of the movable part of the lower half-mold.

2 Claims, 6 Drawing Figures

METHOD AND APPARATUS FOR MANUFACTURING SEPARABLE SLIDING CLASP FASTENERS

The present invention relates to a method of manufacturing separable sliding clasp fasteners, from a continuous fastener comprising two halves each formed of a continuous support-strip carrying a continuous row of interlocking elements made of thermoplastic material. Each separable fastener comprising a separating device formed of one female part and two male parts, one on each of the fastener halves and one of which is displaceable in the female part, a top stop on each of the halves, and a sliding clasp, the movement of which in opposite directions respectively provides locking and unlocking of the two rows of interlocking elements.

The manufacture of sliding clasp fasteners generally comprises first manufacturing a continuous fastener, i.e. a fastener consisting of two continuous support-strips each provided on its inner edge with a continuous row of interlocking elements, then manufacturing from the continuous fastener, the fasteners of desired length, each provided with top and bottom end stops and with a sliding clasp.

Complete separation of a separable sliding clasp fastener as defined above is made possible because of the separating device wherein the female part serves as a bottom stop and one of the male parts is displaceable in the female part, i.e. it can be introduced into it to permit coupling of the two halves of the fastener, and removed from this female part to permit complete separation of these two halves, hence the terms "separable fastener".

The male parts of a separating device must be relatively rigid and be joined to the interlocking elements so as to present a continuity therewith and to permit the clasp of the fastener to slide therein without any hitch.

In known separable sliding clasp fasteners, the male parts of the separating device are generally formed of metallic or plastic bars joined, i.e. fixed, by an appropriate process, to the edge of the support-strip in place of a number of interlocking elements previously stripped off. It is evident that by having to remove a certain number of these elements, to fix in their place a male part prepared in advance, presents technical as well as economical drawbacks.

First of all, such a process is not suitable to be carried out continuously, i.e. in the manufacturing of a series of male parts on each of two halves of a continuous fastener, before cutting up the latter into individual fasteners of a desired length. On the other hand, acceptable joining between a male part and the last interlocking element preceding it is only possible at the cost of a long and delicate adjustment which diminishes the production speed and consequently increases the cost price.

In order to obviate the cited drawbacks, it has been proposed to manufacture the male parts in situ by melting the interlocking elements present in the places provided for these male parts and the additional amount of thermoplastic material necessary to obtain a thickness of the male parts which is required for proper operation of the fasteners. Melting of the interlocking elements and of the added amount of thermoplastic material is performed by ultrasonic heating by a sonotrode forming the upper half-mold and presenting an appropriate form. The added amount of thermoplastic material is generally in the form of a plaquette for each male part to be manufactured.

Such a method has the advantage of allowing the manufacture of male parts of the same material and color as the interlocking elements. It further permits the reinforcement of the support-strip in the region of the male parts at the same time. For this purpose it suffices to provide an appropriate mold and to place upon or under the strip a sheet of thermoplastic material, the melting and penetration of which into the meshes of the strip provides reinforcement of the latter.

However, such a method also presents certain drawbacks which are prejudicial to its application, in particulary for the manufacturing of fasteners wherein the interlocking elements go beyond a certain thickness. As a matter of fact, the thicker these elements are, the better the amount of added thermoplastic material becomes and, consequently, the thickness of the plaquettes to be utilized. It is evident that any increase of the thickness of material to be melted, by means of a sonotrode, makes melting more difficult and lengthy, hence more costly and, at a certain thickness, practically impossible. The heating then only causes a softening of the material in the regions most distant from the sonotrode. This results in an imprecise moulding due to the fact that the material which is not sufficiently fluid does not penetrate sufficiently into all parts of the mould.

The same applies when a similar method is utilized in the manufacturing of the top and bottom stops.

The object of the present invention is to provide a method which obviates the previously cited drawbacks of the known methods.

With this object in view, the method according to the present invention is characterized in that the two male parts of one fastener, the two top stops of another fastener, support-strip reinforcements along the male parts and these stops, and an opening for introducing a sliding clasp, are simultaneously manufactured by:-introducing a section of each of the two unlocked and spaced halves of a continuous fastener into a mold, in such a manner that the support-strip of each section is placed above two strip-reinforcement imprints arranged in a mold, one behind the other at a distance greater then the length of the sliding clasp, and that the row of interlocking elements is placed in a channel traversing the mold and comprising two partitions each adjacent to one of the two opposite ends of the imprints; injecting melted thermoplastic material into the mould; allowing the injected material to solidify; and cutting the slidified material between the two sections, in such a manner as to form the two opposite lateral sides of the two male parts and of the two top stops, and an opening, between these male parts and these stops, having a breadth and a length greater than those of the sliding clasp to be introduced.

In the method according to the present invention, the added thermoplastic material is injected in a melted form into the mold and not melted within the latter, which evidently renders the molding operation much more rapid and consequently less onerous. The injected material being properly fluid, penetrates readily into all parts of the mold, thus providing precise molding. In addition, the amount of added thermoplastic material is more readily determined than in the case when solid material is used in the form of plaquettes.

The present invention also relates to a device for carrying out the method, comprising a mold consisting of a lower half-mold and an upper half-mold, the lower half-mold having, on either side of its axis of symmetry, a channel and two support-strip-reinforcement imprints adjacent to the channel and arranged one behind the other at a distance greater than the length of the sliding clasp, each channel having a partition adjacent to each of the two opposite ends of the imprints, and means for injecting a thermoplastic material into the mold.

The device according to the present invention is characterized in that the lower half-mold and the upper half-mold each comprise a fixed part and a central part movable perpendiculary to this fixed part, that the movable part of the upper half-mold is subjected to the action of an elastic force tending to maintain it in the position at which its lower face is at the level of the fixed part, that the movable part of the lower half-mold is secured to a piston sliding in a sealed chamber which forms a part of the fixed part of this half-mold and is adapted for connection to a source of fluid under pressure, that each of the channels is made in fixed and movable parts of the lower half-mold and that its breadth is greater than that of the row of interlocking elements, and that the line of contact of the fixed and movable parts of the lower half-mold presents the form of the contour of the part of solidified thermoplastic material to be cut between the two sections.

The accompanying drawings represent, schematically and by way of example, a section of a continuous open fastener, before and after carrying out the method, a section of a continuous fastener, after carrying out the method, closed by the inserted sliding clasp and cut for separating two individual neighbouring fasteners, and an embodiment of the device.

Figure 2:
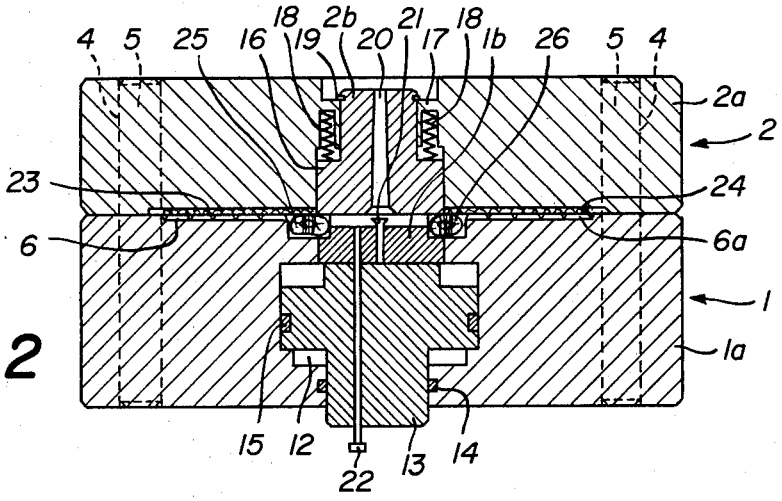
FIG. 2 is a section along the line II—II of FIG. 3 showing the device during molding.
Figure 4:
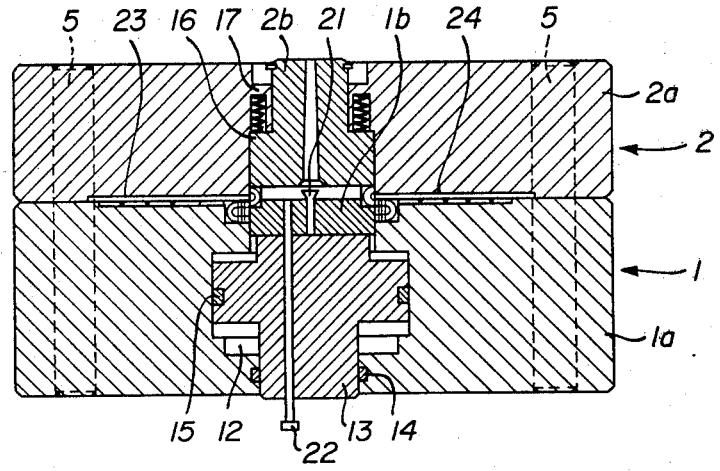
FIG. 4 is a vertical section of the device showing another position of its components.

The device represented in FIGS. 2 and 4 comprises a mould consisting of a lower half-mold 1 and an upper half-mold 2 each consisting of a fixed part 1*a* and 2*a*, respectively, and of a part that is movable perpendicular to a fixed part, 1*b* and 2*b*, respectively. Centering of the mold halves 1 and 2 is obtained by means of centering holes 3 and 4 made in the fixed parts 1*a* and 2*a*, respectively, and of pins 5.

Figure 3:
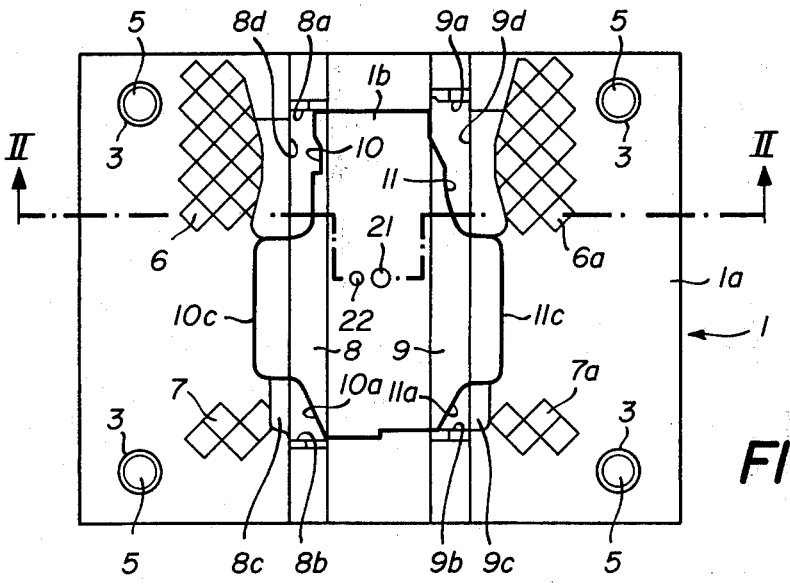
FIG. 3 is a plan view of the lower half of the device of FIG. 2.

Imprints 6, 6*a*, 7, and 7*a* are made in the fixed part 1*a* of the lower half-mold 1. The imprints 6 and 6*a* each represent a reinforcement of the support-strip in the region of a male part of a separating device and are symmetrically arranged with respect to a plane passing through the center of the half-mold 1 and dividing the latter, as noted in FIG. 3, into a left and a right half. The imprints 7 and 7*a* each represent a reinforcement of the support-strip in the region of a top stop and are symmetrically arranged with respect to the said plane, at a distance from the imprints 6 and 6*a* which is greater than length of the sliding clasp with which each fastener will be provided. The lower half-mold 1 is further provided with two parallel channels 8 and 9 arranged symmetrically with respect to said plane and contiguous to the imprints 6 and 7, 6*a* and 7*a* respectively. The channels 8 and 9, which traverse the half-mold 1 from one side to the other, each comprise two transverse partitions 8*a* and 8*b*, 9*a* and 9*b*, respectively, and an enlargement 8*c* and 9*c*, respectively, the role of which will be explained below.

The thick line represents the contour of the movable part of the lower half-mold and consequently the form of the line of contact of the fixed part 1*a* and movable part 1*b* of this half-mold. The upper sections 10 and 11 on the left and right of this line, respectively, represent the form of the opposite lateral sides of the two male parts to be manufactured. The lower sections 10*a* and 11*a* on the left and right, respectively, represent the form of the opposite lateral sides of the two top stops to be manufactured. The middle sections 10*c* and 11*c* on the left and right, respectively, represent the form of the opening to be made between the male parts and the stops for introducing a sliding clasp.

In a chamber 12 made in the fixed part 1*a*, below the movable part 1*b*, a sliding piston 13 is placed, which is provided with sealing segments 14 and 15. The chamber 12 is connected, by means not shown, to a source of fluid under pressure, not shown.

Between a shoulder 16 of the movable part 2*b* and a shoulder 17 of the fixed part 2*a* of the upper half-mold 2, are springs 18 which tend to maintain the movable part 2*b* in the position shown in FIG. 2, i.e. in its lowermost position, determined by abutment of a ring 19, which is rigidly fixed thereto, against the shoulder 17, and for which its bottom face is substantially at the level of the bottom face of the fixed part 2*a*. The movable part 2*b* is traversed by a channel 20 for the injection of a melted thermoplastic material into the interior of the mold. In the movable part 1*b* is fixed an extractor 21 which projects from the top face of this part. An expeller 22 is mounted slidably across the fixed part 1*a* and movable part 1*b* of the lower half-mold 1.

Figure 1:
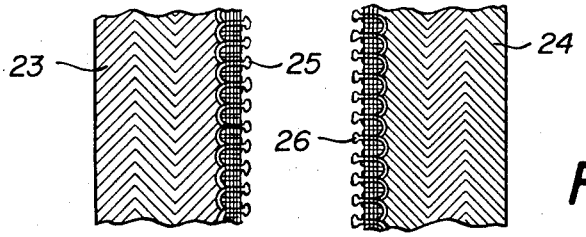
FIG. 1 shows a section of a continuous open fastener.

The method is carried by means of the described device in the following manner:

The mold represented in FIG. 2 is opened by removing the upper half-mould 2. On the lower half-mold 1 are placed the two uncoupled and spaced halves of a continuous fastener, for example those represented in FIG. 1, each formed of a support-strip, 23 and 24, respectively, provided at its inner edge with a continuous row of interlocking elements, 25 and 26, respectively, in such a manner that one section of the support-strip 23 is placed above the imprints 6 and 7, and one section of the support-strip 24 is placed above the imprints 6*a* and 7*a*, and that the row of interlocking elements at the edge of the first section is located in the channel 8 and those of the second section is located in the channel 9. The mould is then closed by setting the upper half-mold 2 down onto the lower half-mold 1. FIG. 2 shows, in cross-section, the closed mold enclosing the two sections of the continuous fastener.

Thermoplastic material is then injected into the closed mold, via the channel 20, and penetrates into the imprints 6, 6*a*, 7 and 7*a*, into the channels 8 and 9 and into the space between the two movable parts 1*b* and 2*b*. The injected material is permitted to solidify and then a fluid under pressure is introduced into the chamber 12 so as to produce displacement of the piston 13 towards the upper half-mold 2 and, consequently, of the two movable parts 1*b* and 2*b* joined together by the solidified material between them, against the action of the springs 18, until the instant when the shoulder 16 of the part 2*b* abuts against the shoulder 17 of the part 2*a*. In the course of this displacement, the movable part 1*b* will cut out, with its edges, the part of the molding and of the support-strips covering its upper surface, hence the part lying within the thick line represented in FIG. 3 and comprising a part of each of the two rows of interlocking elements enclosed in the injected and solidified material. FIG. 4 represents, in cross-section, the position of the various components of the mould at the and of this displacement and of the cutting.

The pressure of the fluid is then removed which will result in the mobile parts 1*b* and 2*b* returning to their position represented in FIG. 2, under the action of the springs 18.

When the upper half-mold 2 is removed to open the mold, the sectioned part, enclosed between the two movable parts 1*b* and 2*b*, will remain attached to the movable part 1*b*, thanks to the extractor 21 from which it will then be separated by means of the expeller 22.

Figure 5:
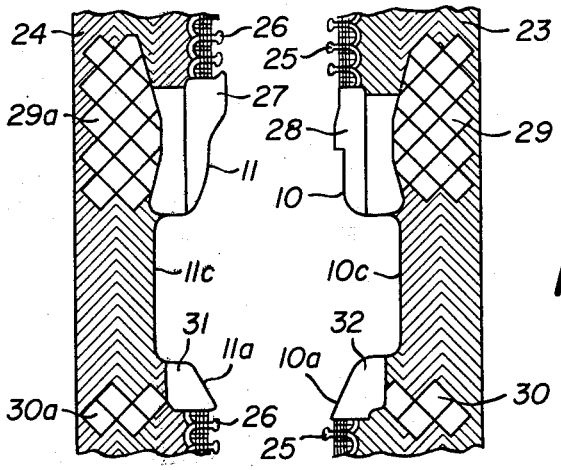
FIG. 5 shows a section of a continuous open fastener, after molding.

After opening the mold, the two sections of the continuous fastener are removed, which then are presented as shown in FIG. 5. It can be seen that each section is provided with a male part, 27 and 28 respectively, with two reinforcements of the support-strip, 29*a*, 30*a* and 29, 30, respectively, and with one top stop, 31 and 32 respectively. The form of each of the male parts 27 and 28 is respectively determined by a wall, 8*d* and 9*d* respectively, of the channel, 8 and 9 respectively, by the partition, 8*a* and 9*a* respectively, which this channel comprises and by the section, 10 and 11, respectively, of the contour of the movable part 1*b* of the lower half-mold 1. The form of each of the top stops 31 and 32 is respectively determined by the enlargements 8*c* and 9*c* of the respective channels 8 and 9, by the respective partitions 8*b* and 9*b* of these channels, and by the respective sections 10*a* and 11*a* of the contour of the movable part 1*b*. The length and the width of the opening to permit a sliding clasp to be positioned are respectively determined by the sections 10*c* and 11*c* of the contour of the movable part 1*b*.

After manufacturing the two male parts for the separating device of a separable fastener, the two top stops for another separable fastener, the reinforcements of the support-strips in the regions of the male parts and the stops, and cutting out the opening for positioning the sliding clasp of the first of these fasteners, the two uncoupled and spaced halves of the continuous fastener can be advanced, to introduce into the mold the two following sections in order to receive another pair of male parts and top stops.

The method according to the present invention may thus be carried out continuously, i.e. manufacture of the male parts and of the top stops may be effected along the whole length of a continuous fastener as it comes from a machine for molding, for weaving or for sewing interlocking elements, before it is cut up into individual fasteners of desired length.

As appears from the description of the operation of the device according to the present invention, this allows the molding and cutting necessary for carrying out the method to be effected successively without it being necessary to manipulate the two uncoupled halves of the continuous fastener. It thus permits the method to be carried out with high speed and precision.

Figure 6:
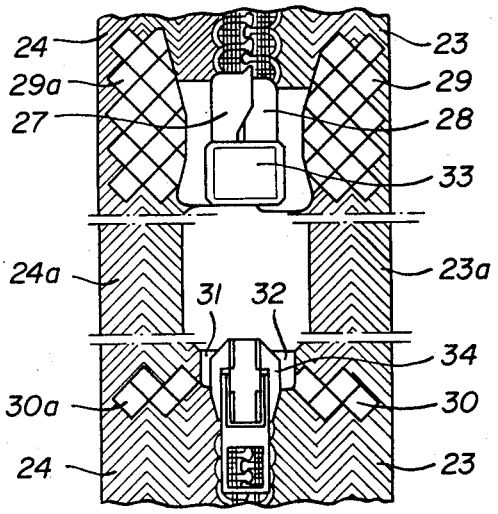
FIG. 6 shows a section of a continuous fastener, after moulding, closed by the inserted sliding clasp and cut for separating two individual neighbouring fasteners.

After having provided a continuous fastener with a number of pairs of male parts and top stops corresponding to the number of separable fasteners one wishes to obtain, one can apply one of the known methods for positioning sliding clasps and female parts for separating devices, and for sectioning the continuous fastener into individual fasteners of desired length. FIG. 6 shows the sections of FIG. 5 at the end of these operations.

As can be seen in this FIG., the two sections are coupled by the inserted sliding clasps and then the upper part of the sole section thus obtained, comprising a separating device formed of male parts 27 and 28 and female part 33. The reinforcements 29 and 29*a*, are separated from the lower part comprising the stops 31 and 32 and a sliding clasp 34 in an abutting position against these stops, by sectioning in two places, in the vicinity of the male parts and in the vicinity of the stops, to remove the sections of the support-strips lying between these upper and lower parts, the sections 23*a* and 24*a*.

These upper and lower parts respectively constitute the lower end of a separable fastener and the upper end of another separable fastener.

In the separating device represented in FIG. 6, it is the male part 27 which is removable, i.e. it can be removed from the female part 33, to allow complete separation of the two halves of the fastener, while the male part 28 is solidly secured to the female part 33.

I claim:

1. In a method of manufacturing separable sliding clasp fasteners, from a continuous fastener comprising two halves each formed of a continuous support-strip carrying a continuous row of interlocking elements made of thermoplastic material, each separable fastener comprising a separating device formed of one female part and two male parts, one on each of the fastener halves and one of which is displaceable in the female part, a top stop on each of the halves, and a sliding clasp, the movement of which in opposite directions respectively provides locking and unlocking of the two rows of interlocking elements, the improvement which comprises said two male parts of one fastener, the two top stops of another fastener, support-strip reinforcements along the male parts and said stops, and an opening for introducing a sliding clasp, are simultaneously prepared by introducing a section of each of the two uncoupled and spaced halves of a continuous fastener into a mold in such a manner that the support-strip of each section is placed above two strip-reinforcement imprints arranged in the mold one behind the other at a distance greater than the length of the sliding clasp, and that the row of interlocking elements is placed in a channel traversing the mold and formed from two partitions, each of said partitions being adjacent to one of the two opposite ends of the imprints; injecting melted thermoplastic material into the mold; permitting the injected material to solidify, and then cutting the solidified material between the two sections in such a manner as to form the two opposite lateral sides of the two male parts and of the two top stops, and an opening between said male parts and said male parts and said stops having a breadth and a length greater than those of a sliding clasp to be introduced.

2. In a device for manufacturing separable sliding clasp fasteners, comprising a mold consisting of a lower half-mold and of an upper half-mold, the lower half-mold comprising, on either side of its axis of symmetry, a channel and two support strip reinforcement imprints adjacent to the channel and arranged one behind the other at a distance greater than the length of the sliding clasp, each channel comprising a partition adjacent to each of the two opposite ends of the imprints, and means for injecting a thermoplastic material into said mold, the improvement which comprises said lower half-mold and said upper half-mold each comprising a fixed part and a central part movable perpendicularly to said movable part of said upper half-mold being subjected to the action of an elastic force tending to maintain it in the position at which its lower face is at the level of that of the fixed part, said movable part of the lower half-mold being secured to a piston sliding in a sealed chamber which forms a part of the fixed part of the half-mold and is adapted for connection to a source of fluid under pressure, each of said channels being made in the fixed and movable parts of the lower half-mold and having a breadth greater than that of the row of interlocking elements, and the line of contact of the fixed and movable parts of the lower half-mold having a form of the contour of the part of solidified thermoplastic material to be cut between the two sections.

* * * * *

UNITED STATES PATENT AND TRADEMARK OFFICE

CERTIFICATE OF CORRECTION

PATENT NO. : 4,074,413

DATED : February 21, 1978

INVENTOR(S) : Ricardo Taccani

It is certified that error appears in the above—identified patent and that said Letters Patent is hereby corrected as shown below:

Column 7, line 2, after "to" should read -- said fixed part,".

Signed and Sealed this

*Twenty-fifth* Day of *August 1981*

[SEAL]

*Attest:*

GERALD J. MOSSINGHOFF

*Attesting Officer*

*Commissioner of Patents and Trademarks*